US007417641B1

(12) United States Patent
Barber et al.

(10) Patent No.: US 7,417,641 B1
(45) Date of Patent: Aug. 26, 2008

(54) AERONAUTICAL CHART DISPLAY APPARATUS AND METHOD

(75) Inventors: Sarah Barber, Robins, IA (US); Lyndon L. Dunbar, Cedar Rapids, IA (US); Deborah Hardin, Cedar Rapids, IA (US); Kirschen A. Seah, Robins, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 150 days.

(21) Appl. No.: 10/272,563

(22) Filed: Oct. 16, 2002

(51) Int. Cl.
*G09G 5/02* (2006.01)

(52) U.S. Cl. ..... 345/589; 340/995.14; 340/995.27; 342/25 A; 345/440; 382/113; 382/167; 701/10; 701/14; 701/17; 701/21; 701/120; 701/208

(58) Field of Classification Search ..... 345/601, 345/589; 340/995.14, 995.27, 165–167
See application file for complete search history.

(56) References Cited

U.S. PATENT DOCUMENTS

| | | | | |
|---|---|---|---|---|
| 4,876,651 | A * | 10/1989 | Dawson et al. | 701/200 |
| 4,965,574 | A * | 10/1990 | Fukushima et al. | 340/995.27 |
| 4,965,845 | A * | 10/1990 | Chan et al. | 382/166 |
| 5,459,824 | A * | 10/1995 | Kashiwazaki | 345/593 |
| 5,546,091 | A * | 8/1996 | Haugen et al. | 342/181 |
| 5,757,359 | A * | 5/1998 | Morimoto et al. | 345/156 |
| 5,937,089 | A * | 8/1999 | Kobayashi | 382/167 |
| 6,289,277 | B1 * | 9/2001 | Feyereisen et al. | 701/202 |
| 6,342,896 | B1 * | 1/2002 | Shetter et al. | 345/589 |
| 6,421,604 | B1 * | 7/2002 | Koyanagi et al. | 701/208 |
| 6,567,069 | B1 * | 5/2003 | Bontrager et al. | 345/156 |
| 6,600,489 | B2 * | 7/2003 | Cook | 345/426 |
| 6,756,919 | B2 * | 6/2004 | Endo et al. | 340/995.14 |
| 7,126,610 | B2 * | 10/2006 | Hammond | 345/589 |

FOREIGN PATENT DOCUMENTS

| | | | |
|---|---|---|---|
| JP | 2003248475 | * | 9/2003 |

OTHER PUBLICATIONS

Lind, R., Schumacher, R., Reger, R., Olney, R., Yen, H., and Laur, M., "The Network Vehicle—A Glimpse into the Future of Mobile Multi-Media," IEEE AES Systems Magazine, Sep. 1996, pp. 27-32.*

Montgomery, J., Sanderson, R., and Baxley, F., "Two Color Temporally Correlated Infrared Background Measurements," IEEE AES Systems Magazine, Apr. 1998, pp. 29-35.*

Monarchie, D., Budzilek, R., Cupero, F., "Sunlight Viewable Electroluminescent Displays for Military Applications," IEEE AES Systems Magazine, Aug. 1995, pp. 21-24.*

(Continued)

*Primary Examiner*—Kee M. Tung
*Assistant Examiner*—Antonio A Caschera
(74) *Attorney, Agent, or Firm*—Nathan O. Jensen

(57) ABSTRACT

A method and apparatus for converting electronic display aeronautical chart data to aeronautical chart data that is tailored for an avionics display is disclosed. The method and apparatus received by a data processing unit, electronic display aeronautical chart data. The color palette of the electronic display aeronautical chart data is then remapped to improve viewability on the avionics quality display. Finally, signals representative of the remapped colors are sent to the avionics quality display.

12 Claims, 4 Drawing Sheets

OTHER PUBLICATIONS

Weindorf, P., "The C-17 Multifunction Display, A Building Block for Avionics Systems," IEEE AES Magazine, Jul. 1992, pp. 32-39.*

Buxton, J., Honey, S., Suchowerskyj, W., Tempelhof, A., "The Travelpilot: A Second-Generation Automotive Navigation System," IEEE Transaction on Vehicular Technology, vol. 40, No. 1, Feb. 1991, pp. 41-44.*

Myrick et al., Stephanie. "Color Reproduction Based on Red, Green, and Blue Primaries for a Cyan-, Magenta-, and Yellow-Based Hardcopy Device." NRL/FR/7441-92-9417, Aug. 1993. Date accesed Jul. 17, 2007 via web @ http://mmc.nrlssc.navy.mil/publications/public/Myrick-NRL-FR-92-09417.pdf.*

* cited by examiner

AERONAUTICAL CHART DISPLAY APPARATUS AND METHOD

BACKGROUND

Conventional aeronautical chart files provided by such manufacturers as Jeppesen Sanderson, Inc. of Denver, Colo. are configured for charting on paper and possibly for displaying on conventional personal computers (PCs). Such conventional aeronautical chart file information is not tailored for avionics quality displays which may be used in a cockpit or other location inside an aircraft. Also, conventional aeronautical chart files are not tailored for displaying on most conventional electronic displays.

Aeronautical chart files are conventionally created using RGB colors, fonts, and graphics rendering techniques for personal computers, in order to achieve high quality paper charts. The result of displaying such conventional aeronautical chart files on an electronic display, such as, but not limited to, an avionics quality or commercial quality display, results in reduced readability, especially in cockpit ambient illumination conditions, and reduced color contrast compared to paper charts. In particular, for liquid crystal displays (LCDs), characteristics may also include color shifts over a range of viewing angles and poor font quality.

Accordingly, there is a need for a system and method to convert aeronautical chart files into files which are usable in an avionics quality display environment. There is also a need for a method of remapping conventional aeronautical chart colors to colors which will be more readily usable, readable, and provide better contrast and reduced luminance for an avionics quality display. Further, there is a need for a method and apparatus for remapping a white background color to a background color that does not conflict with other chart features and that provides color contrast for sunlight, diffused light, and night viewing conditions, as well as providing reduced luminance while maintaining good color contrast. Further still, there is a need for a system and method for using conventional aeronautical chart data and remapping conventional fonts and line widths to appropriate fonts and line widths for improved readability on an avionics quality display.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

An example of the invention relates to a method of converting electronic display aeronautical chart data to aeronautical chart data tailored for an avionics quality display. The method includes receiving by a data processing unit, electronic display aeronautical chart data. The method also includes remapping the color palette of the electronic display aeronautical chart data, to improve viewability on the avionics quality display. Further, the method includes sending signals representative of the remapped colors to the avionics quality display.

Another example of the invention relates to a method of converting an aeronautical chart file to an avionics display file. The method includes remapping the background color of an aeronautical chart file to a display background color having subdued background luminance.

Yet another example of the invention relates to a computer readable medium, having a program stored thereon. The program includes a first set of instructions to remap the background color of an aeronautical chart file to a display background color having subdued background luminance and a second set of instructions to store data representative of the display background color in an avionics display file.

Alternative exemplary embodiments relate to other features and combination of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF PREFERRED AND EXEMPLARY EMBODIMENTS

Figure 1:
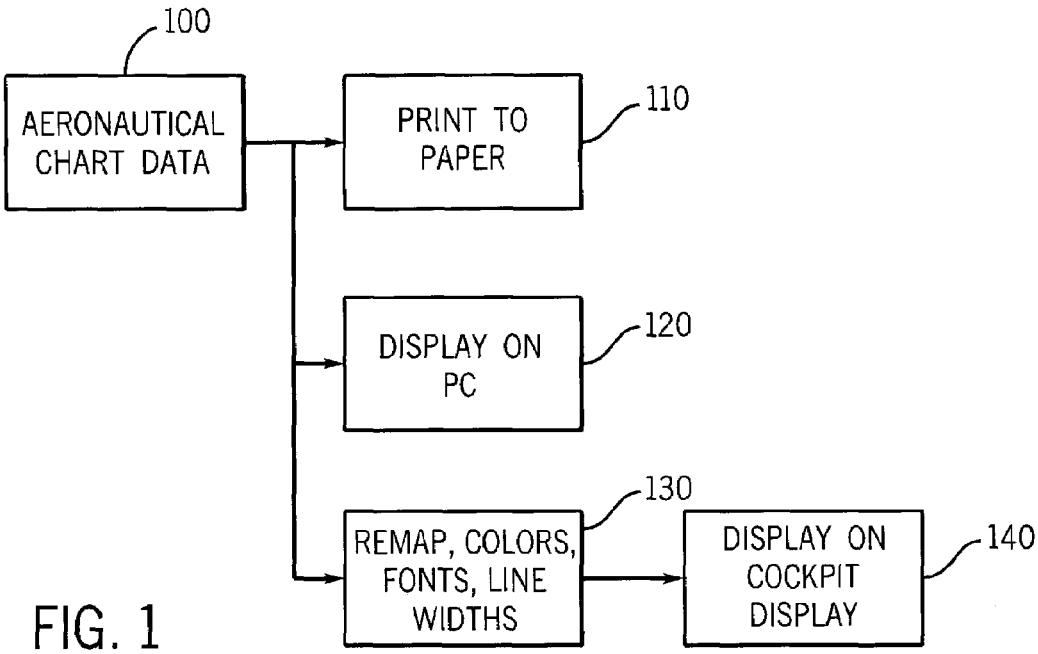
FIG. 1 is an exemplary block diagram depicting possible display options for aeronautical chart data.

Referring now to FIG. 1, conventionally, aeronautical chart data 100 is captured by an aeronautical chart data supplier and is conventionally used to print aeronautical charts on paper (operation 110). Alternatively, aeronautical chart data 100 may be displayed on computers such as, displaying on a personal computer (operation 120). In conventional systems of today, aeronautical chart data uses the RGB format for displaying on a PC, often in a Microsoft Windows environment. Such chart data may be stored on the PC or laptop computer and, if stored on a laptop computer, may be carried with a flight crew on board an aircraft. Access to the aeronautical chart data is then made using the laptop computer on the aircraft.

However, it is desirable to display chart information on an avionics display integrated into the aircraft cockpit or other location on the aircraft. Such an avionics quality display needs to meet certain desired characteristics, such as, but not limited to, readability, especially providing color contrast for sunlit, diffuse sunlit, and night viewing conditions as well as reduced luminance of the display such that the background color of the aeronautical chart shown on the display does not provide an undesired brightness within the flight cabin when flying at night. Accordingly, aeronautical chart data 100 may be remapped in terms of colors, fonts, and line widths (operation 130) by an on-board computer or other data processing device which may be on-board or not on-board the aircraft. Once the colors, fonts, and line widths have been remapped, the aeronautical chart data, in a preferred display format, will be displayed on the avionics quality display (operation 140) in the cockpit or other locations on-board the aircraft.

Figure 2:
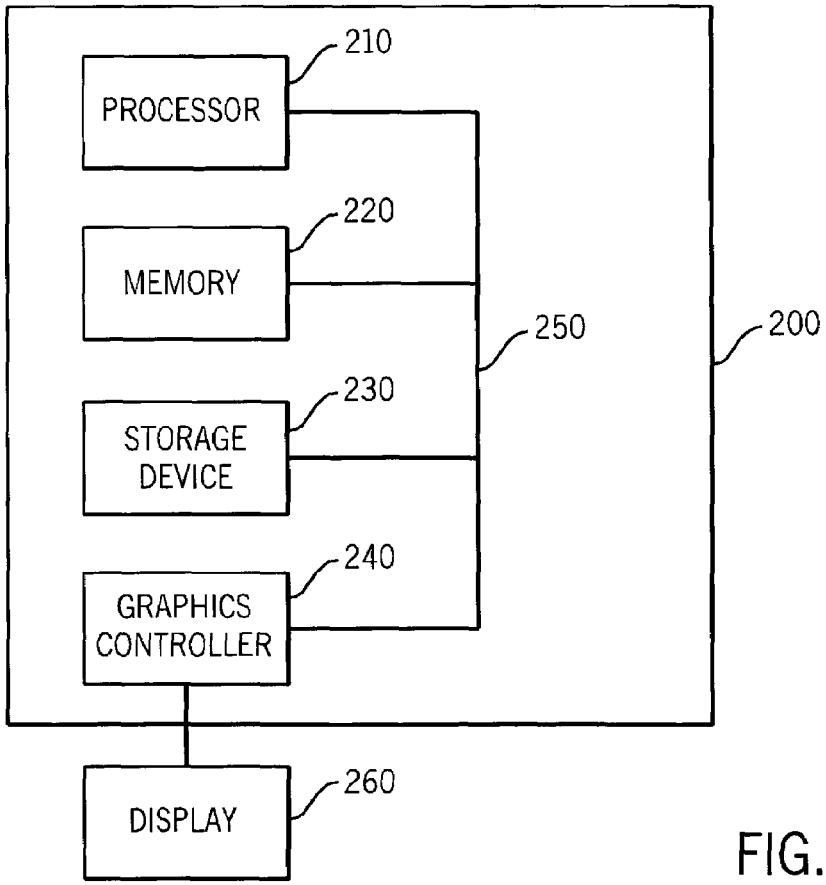
FIG. 2 is an exemplary block diagram of an avionics computer and display.

Referring to FIG. 2, an avionics computer 200, may, in an exemplary embodiment, include a processor 210, a memory 220, a storage device 230, and a graphics controller 240, all coupled to and communicating on a bus 250. Processor 210 is configured to run programs (i.e. sets of instructions) stored in memory 220 and/or stored in storage device 230. Storage device 230 may be any of a variety of storage devices, including, but not limited to, magnetic storage devices (tapes, disc drives, etc.), optical devices, flash memory, read only memory, and other memory devices, etc. Storage device 230 may be used to store aeronautical chart data preferably in a format which is suitable for displaying on an avionics quality display in a flight cabin. Graphics controller 240 communicates with processor 210 and controls the display of information on display 260. In an exemplary embodiment, graphics controller 240 may include a GE3 graphics processor available from Rockwell Collins, Inc. of Cedar Rapids, Iowa, however, the graphics controller may be any other suitable device. Display 260 may be, in an exemplary embodiment, an avionics quality display (such as, but not limited to, an AFD 3010 or AFD 3010E avionics display available from Rockwell Collins, Inc. of Cedar Rapids, Iowa) that is used in the flight cabin for displaying chart data and/or other types of flight information or aircraft information to a pilot or other person on the flight crew.

In an exemplary embodiment, the color remapping referred to in operation 130, which may be carried out by processor 210 or another computer which is not on-board the aircraft, uses the color palette chart shown below to remap the colors, in the aeronautical chart data, to colors for the avionics quality display. The color palette chart below depicts the original aeronautical chart color palette and the remapped target color palette. For example, the fourth row of the table corresponds to the aeronautical chart color Red having RGB values of 255, 000, and 000, respectively. This is remapped into a PC based platform color having RGB values of 192, 000, and 000, with a target platform color having Hex value of 0000C0 and is typically used for airport diagram hot spots. The color red also corresponds to a chromaticity value of u'=0.4272, v'=0.5184, and fL=5.42.

Summary Chart Color Palette

| | Original Jeppesen Chart Color Palette | | | PC Prototype Platform Remap | | | Target Platform Remap (GE3 | Target Platform Chromaticity | | | |
|---|---|---|---|---|---|---|---|---|---|---|---|
| Color | Red | Green | Blue | Red | Green | Blue | Hex Value) | u' | v' | fL | |
| Black | 000 | 000 | 000 | | | | 000000 | 0.1881 | 0.4245 | 0.07 | Symbology |
| White | 255 | 255 | 255 | | | | FFFFFF | 0.2077 | 0.4614 | 22.1 | Fonts, Symbology Fill |
| Off White | 254 | 254 | 254 | | | | FFFFFF | | | | Fonts, Symbology Fill |
| Red | 255 | 000 | 000 | 192 | 000 | 000 | 0000C0 | 0.4272 | 0.5184 | 5.42 | Airport Diagram Hot Spots |
| Yellow | 255 | 255 | 000 | | | | FFFF00 | 0.2257 | 0.5506 | 18.64 | Symbology Fill |
| Blue 1 | 150 | 200 | 255 | 080 | 160 | 255 | FFA050 | 0.1786 | 0.43 | 15.66 | Water |
| Blue 2 | 150 | 200 | 250 | 080 | 160 | 255 | FFA050 | | | | Water |
| Blue 3 | 000 | 255 | 255 | | | | (none) | | | | Not visible in charts |
| Blue 4 | 000 | 000 | 255 | | | | FFA050 | | | | Water |
| Blue 5 | 255 | 192 | 203 | | | | (none) | | | | Not visible in charts |
| Blue 6 | 208 | 208 | 255 | | | | FFA050 | | | | Water |
| Gray 1 | 204 | 204 | 204 | 144 | 144 | 144 | ACACAC | 0.2042 | 0.4534 | 17.09 | Roads |
| Gray 2 | 179 | 179 | 179 | 096 | 096 | 096 | A0A0A0 | 0.2041 | 0.4511 | 17.21 | Non-lighted Taxiways |
| Gray 3 | 171 | 171 | 171 | 080 | 080 | 080 | 949494 | 0.2032 | 0.4481 | 16.62 | Closed Runways |
| Gray 4 | 164 | 164 | 164 | | | | 888888 | 0.202 | 0.4456 | 15.8 | Varied Symbology |
| Gray 5 | 158 | 158 | 158 | | | | 7C7C7C | 0.2016 | 0.4416 | 14.6 | Varied Symbology |
| Gray 6 | 150 | 150 | 150 | 112 | 112 | 112 | 707070 | 0.2006 | 0.4399 | 13.48 | Lighted Taxiway Outline |
| Gray 7 | 145 | 145 | 145 | 112 | 112 | 112 | 646464 | 0.2003 | 0.4388 | 12.6 | Lighted Taxiway |
| Gray 8 | 132 | 132 | 132 | | | | 585858 | 0.1999 | 0.436 | 11.2 | Varied Symbology |
| Gray 9 | 117 | 117 | 117 | | | | 4C4C4C | 0.1987 | 0.4355 | 9.92 | Varied Symbology |
| Gray 10 | 104 | 104 | 104 | | | | 404040 | 0.1992 | 0.4342 | 9.02 | Bearing Frequencies, Marker Beacons, Movement Boundaries |
| Terrain 1 | 235 | 210 | 165 | | | | 90D8E0 | 0.2082 | 0.464 | 15.22 | Level of Terrain |
| Terrain 2 | 228 | 200 | 155 | | | | 80C4DC | 0.2102 | 0.4656 | 15.38 | Level of Terrain |
| Terrain 3 | 230 | 165 | 120 | | | | 64A8E4 | 0.217 | 0.4717 | 14.69 | Level of Terrain |
| Terrain 4 | 240 | 140 | 090 | | | | 548CE8 | 0.2194 | 0.4718 | 13.94 | Level of Terrain |
| Terrain 5 | 235 | 155 | 105 | | | | 5C9BE4 | 0.2249 | 0.4753 | 13.26 | Level of Terrain |
| Terrain 6 | 240 | 135 | 080 | | | | 5087EC | 0.2286 | 0.4768 | 13.1 | Level of Terrain |
| Terrain 7 | 233 | 127 | 080 | | | | 4C78E9 | 0.231 | 0.476 | 12.6 | Level of Terrain |

-continued

Summary Chart Color Palette

| Color | Original Jeppesen Chart Color Palette Red | Green | Blue | PC Prototype Platform Remap Red | Green | Blue | Target Platform Remap (GE3 Hex Value) | Target Platform Chromaticity u' | v' | fL | |
|---|---|---|---|---|---|---|---|---|---|---|---|
| Terrain 8 | 210 | 110 | 060 | | | | 3C6ED2 | 0.2345 | 0.4781 | 11.61 | Level of Terrain |
| Terrain 9 | 230 | 119 | 080 | | | | 446CE0 | 0.2311 | 0.4826 | 11.73 | Level of Terrain |
| Terrain 10 | 190 | 080 | 030 | 240 | 128 | 064 | 4080F0 | 0.2281 | 0.4845 | 13.55 | Terrain Line Contour |
| Terrain 11 | 165 | 042 | 042 | | | | 2A2AA5 | 0.2908 | 0.4696 | 6.73 | Terrain Contour Altitude Text |
| Chart Background | N/A | | | | | | N/A | 0.1778 | 0.4235 | 33.26 | This color is inherent in the spatial modulation pattern of the background and provides color contrast for sunlight, diffuse sunlight and night viewing |

In an exemplary embodiment, in order to implement a color remapping of the type described, RGB values in the original chart file may be remapped in terms of gray scales that result in color, color contrast, and color saturation differences representative of those in paper printed charts. When the gray scales are remapped, it is beneficial to have the gray scales providing more separation and a more linear relationship thereby providing better contrast and more uniform separation.

Once the colors are remapped, the chart feature chromaticity can be measured on the target platform to confirm that they are consistent with the color palette that is desired. Also, the typically white background that is used in conventional paper aeronautical charts is remapped into a preferable gray-green color or another color that does not conflict with chart features and that provides color contrast for sunlight, diffuse sunlight, and night viewing conditions. In a preferred embodiment, chromaticity coordinates are u'=0.1778, v'=0.4235, and fL=33.26 (see, last row of Summary Chart Color Palette). However, other colors may be used having other chromaticity coordinates that provide the desired background and contrast, without departing from the scope of the invention.

Once the chromaticity coordinates are defined, an interwoven elemental spatial modulation pattern for the chart background is defined and implemented. In preferred embodiments, the implementation of the gray-green background color reduces the luminance of the background by approximately 22% and facilitates the color stability of the chart features. Further, in an exemplary embodiment, new font types are defined and implemented for the avionics display that preferably maintain the original chart file font style. Also, an algorithm may be implemented that dynamically displays a given font at a given line width depending on the point size displayed, and redefines the line widths for chart features (e.g., for terrain contours). In an exemplary embodiment, a relationship may be developed between font point size and line width in order to provide the proper character lines such that they are perceived to be the correct line width, that is, the line width of the corresponding font in the original aeronautical chart. Such a relationship may be, but is not limited to, line width=(point size×K)+C where K and C are defined constants. In an exemplary embodiment, the constants may be defined according to the font being used, for example, as shown in the table below.

TABLE 1

"K" and "C" Line Width Constants

| Font ID | K | C |
|---|---|---|
| 11 | 0.18 | 0.45 |
| 12 | 0.22 | 0.00 |
| 13 | 0.14 | 0.25 |
| 15 | 0.10 | 0.80 |
| 16 | 0.15 | 0.47 |
| 17 | 0.08 | 0.90 |
| 32 | 0.06 | 1.05 |
| 34 | 0.14 | 0.62 |
| 35 | 0.00 | 0.00 |
| 43 | 0.15 | 0.00 |
| 52 | 0.07 | 0.00 |
| 79 | 0.31 | 0.00 |
| 80 | 0.07 | 0.00 |
| 82 | 0.20 | 0.00 |

Similarly, as can be seen in the chart, other mappings are done. Further, for some mappings, no remapping is necessary. For example, in the first row, RGB values of 000,000, and 000, there is no corresponding remapped color in the remapped color palette because no remapping was necessary for the color Black.

In an exemplary embodiment, remapping of the color palette from the original aeronautical chart file to the aeronautical chart file which is tailored for the avionics quality display, requires a remapping of the background color. Preferably, the remapped background color is a green, a gray, or a gray-green color especially in the case that the original aeronautical chart background color was substantially white. The use of a gray-green background color provides an avionics display having reduced luminance over a white background color. Accordingly, the display will not appear too bright in the flight cabin. Further, the gray-green color provides good contrast with other chart feature colors. In an exemplary embodiment, no other chart feature colors are close to the gray-green background color.

Figure 5:
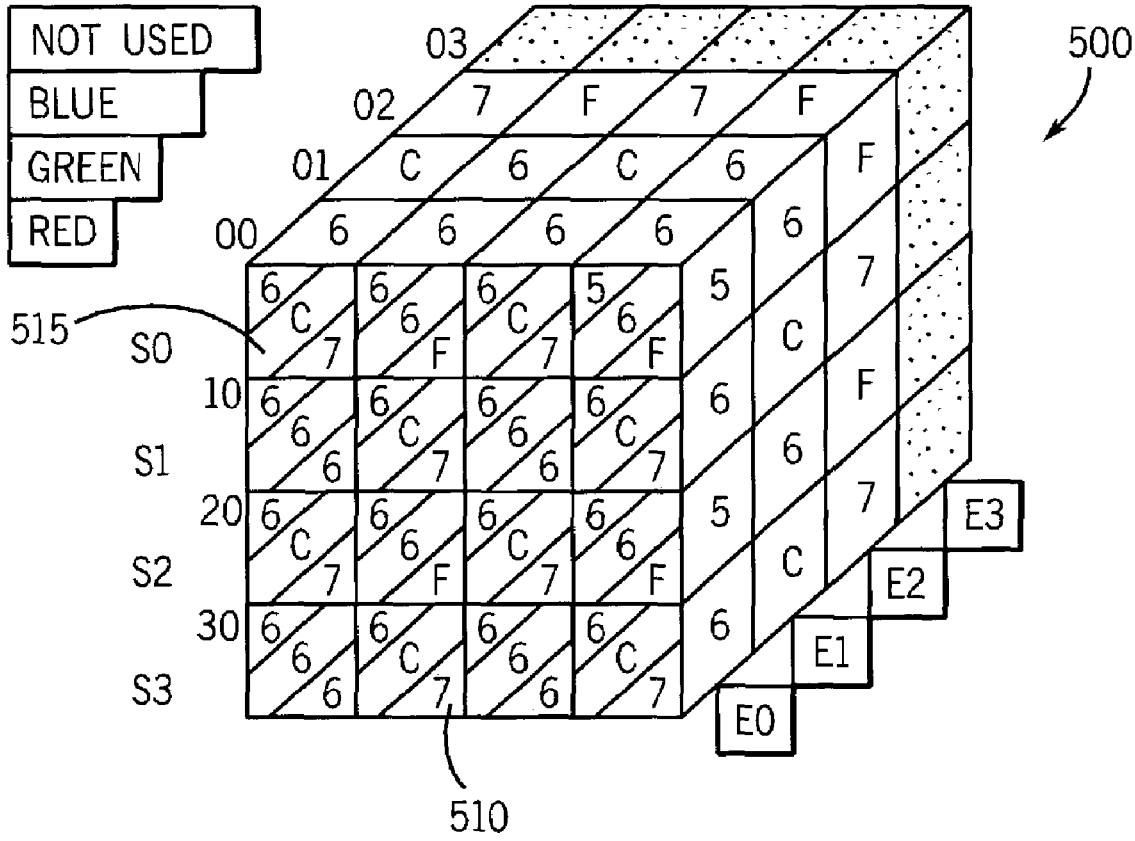
FIG. 5 is an exemplary depiction of an interwoven elemental spatial modulation pattern used in the avionics display.

In a preferred embodiment, an interwoven elemental spatial modulation pattern is used to implement colored pixels on an avionics quality display. For example, an interwoven elemental spatial modulation pattern 500 is depicted in FIG. 5. The front face 510 of pattern 500 is representative of the underlying elements making up the 16 pixels in a 4×4 format. However, a 4×4 format is not required to remain within the scope of the invention. Each element 515 includes a red, green, and blue color intensity which is used and modulated to provide a substantial number of color combinations when using red, blue and green elements. Each of the red, green and blue elements has a different light output capability. The use of an interwoven elemental spatial modulation technique provides flexibility in the number of colors and intensities available to a user of the system. Each of the numbers represented in the squares 515 of the grid are hexadecimal representations for the intensity of the particular element. For example, in square 515, 6 is representative of the red intensity, "C" is representative of the green intensity, and 7 is representative of the blue intensity.

Figure 3:
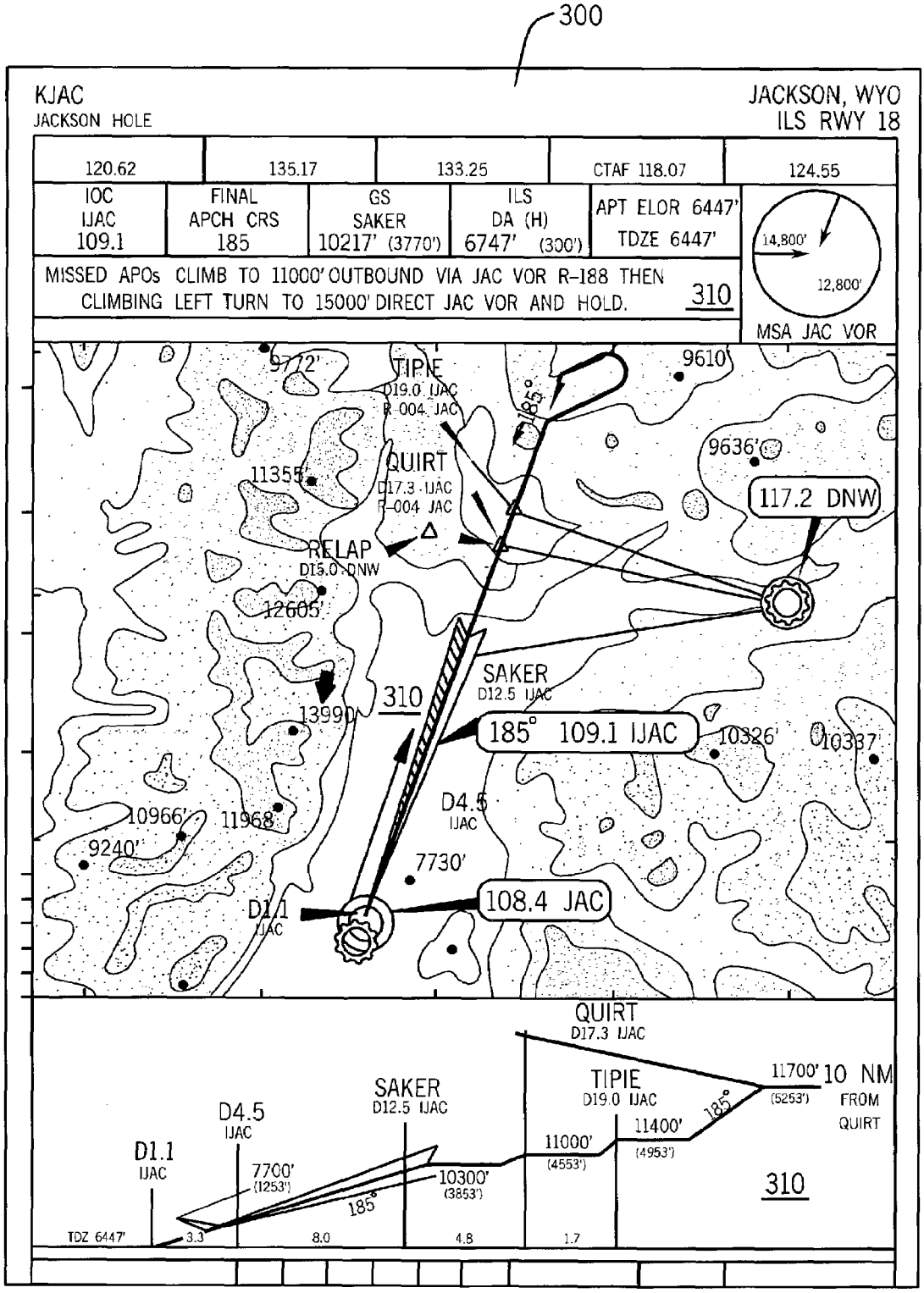
FIG. 3 is an exemplary depiction of an aeronautical chart displayed on an avionics quality display prior to remapping of colors, fonts, and line widths.

Referring back to FIG. 3, an exemplary representation of a conventional aeronautical chart that has been displayed on an avionics quality display is depicted. Chart 300 shows a substantially white background color 310 at various locations in the chart 300. The use of the substantially white background color is not conducive to low light conditions in an aircraft flight cabin because the use of the substantially white color would cause the cabin to be highly illuminated from the display, causing fatigue and/or distraction. Further, it is desirable to use other background colors which provide contrast for sunlight, diffuse sunlight, and night viewing conditions.

Figure 4:
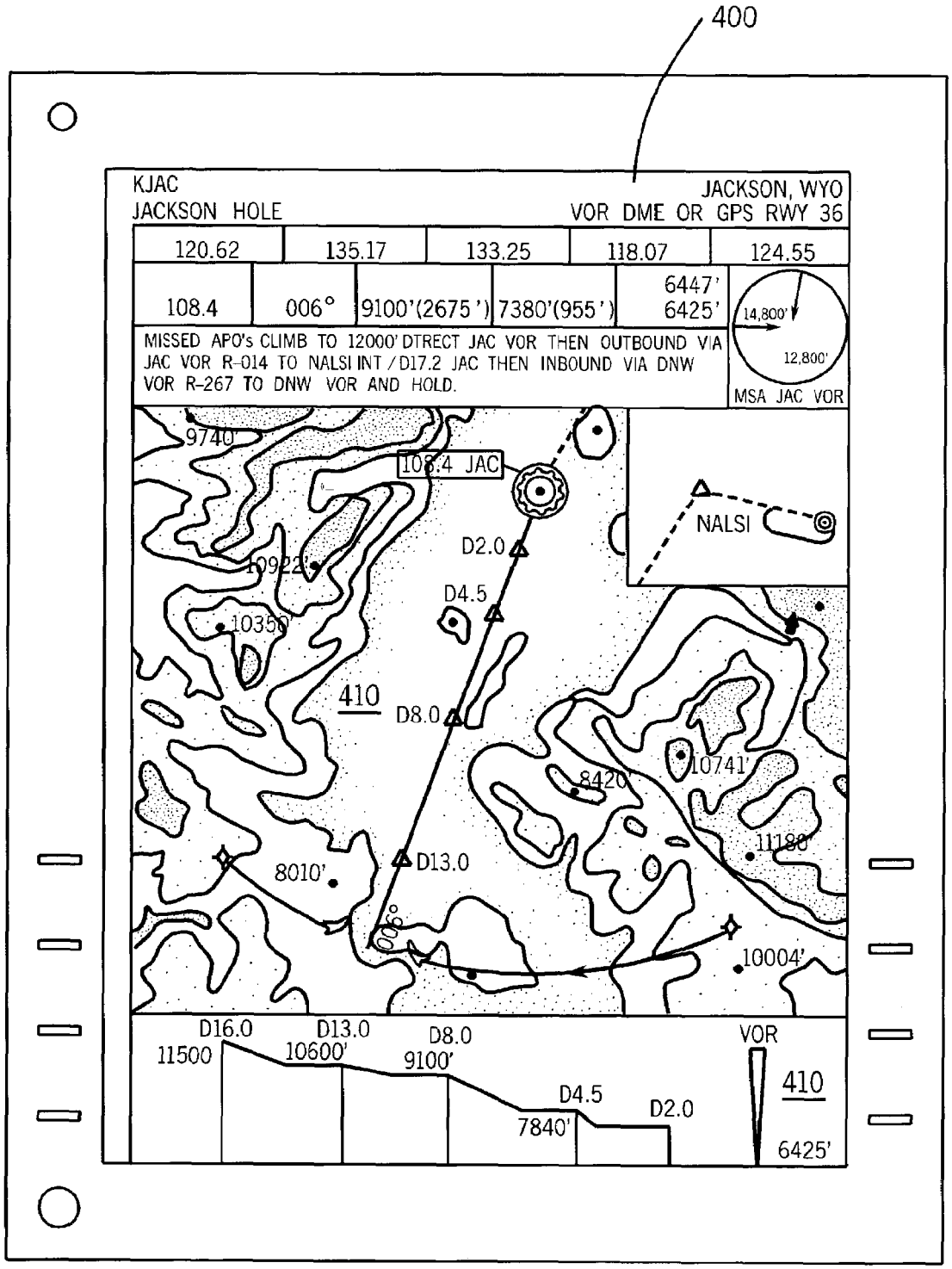
FIG. 4 is an exemplary depiction of an avionics after color remapping, line width redefinitions, and font redefinitions.

Accordingly, referring to FIG. 4, a chart 400 is depicted having remapped colors, line widths, and fonts. The spatially modulated background color 410 provides the desired contrast and illumination characteristics, and, in a preferred embodiment, is a gray-green color. Further, in another exemplary embodiment, the spatially modulated background color 410 includes green and/or gray. As well, other colors used in chart 300 are remapped into alternative colors that are used in chart 400. The remapped colors, for example, in accordance with the previous color palette remapping chart are used to provide the desired contrast and illumination for the avionics quality display. Further still, line widths used in chart 300 may be remapped to a more usable line width for display 400. Further still, fonts used in chart 300 are remapped into fonts that are line drawn fonts used in chart 400. Redrawing of lines, or redefining of line widths, as well as defining of fonts provides clarity to the information displayed on display 400.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing and display devices. For example, the type of computing device, communications bus, processor, or display hardware used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A method of converting electronic display aeronautical chart data to aeronautical chart data tailored for an avionics display, comprising:

receiving by a data processing unit, electronic display aeronautical chart data, wherein a background color of the electronic display aeronautical chart data is white;

remapping the color palette of the electronic display aeronautical chart data, to improve viewability on the avionics display, including a remapping of the background color from white to green;

sending signals representative of the remapped colors to the avionics display;

defining chromaticity coordinates based on the remapped colors;

sending signals representative of the chromaticity coordinates to the avionics display; and redefining line widths read from the aeronautical chart file to be displayed on the avionics display.

2. The method of claim 1, further comprising:

redefining fonts read from the aeronautical chart file.

3. The method of claim 1, wherein the remapped background color provides contrast with an aeronautical chart data palette.

4. A method of converting an aeronautical chart file to an avionics display file, comprising:

remapping a white background color of an aeronautical chart file to a green display background color having subdued background luminance;

redefining the chromaticity coordinates of the background color based on the remapping;

using the combined remapped background color and the redefined chromaticity coordinates in the avionics display file; and redefining line widths read from the aeronautical chart file to be displayed on the avionics display.

5. The method of claim 4, further comprising:

redefining fonts read from the aeronautical chart file.

6. The method of claim 4, wherein the display background color provides contrast with an aeronautical chart file data palette.

7. A computer readable medium having a program stored thereon, the program comprising:

a first set of instructions to remap a white background color of an aeronautical chart file to a green display background color having subdued background luminance;

a second set of instructions to store data representative of the green display background color in an avionics display file; and a third set of instructions to cause changes in intensity of individual colored pixel elements on an avionics display based on the output of the first and second set of instructions.

8. The computer readable medium of claim 7, further comprising:

a fourth set of instructions to redefine line widths read from the aeronautical chart file.

9. The computer readable medium of claim 7, further comprising:

a fourth set of instructions to redefine fonts read from the aeronautical chart file.

10. The computer readable medium of claim 7, wherein the display background color provides contrast with an aeronautical chart file data palette.

11. The computer readable medium of claim 7, wherein the computer readable medium is included in an avionics subsystem.

12. The computer readable medium of claim 7, wherein the computer readable medium is included in an electronics subsystem used to drive an avionics display.

* * * * *